US008686907B2

(12) United States Patent
Jan et al.

(10) Patent No.: US 8,686,907 B2
(45) Date of Patent: Apr. 1, 2014

(54) ANTENNA DEVICE

(75) Inventors: Cheng-Geng Jan, Hsinchu (TW); I-Shan Chen, Hsinchu (TW); Chia-Hong Lin, Hsinchu (TW); Tien-Min Lin, Hsinchu (TW); Yi-Cheih Wang, Hsinchu (TW); Cheng-Hsiung Hsu, Hsinchu (TW)

(73) Assignee: Wistron Neweb Corporation, Hsinchu (TW)

( * ) Notice: Subject to any disclaimer, the term of this patent is extended or adjusted under 35 U.S.C. 154(b) by 175 days.

(21) Appl. No.: 13/440,189

(22) Filed: Apr. 5, 2012

(65) Prior Publication Data

US 2013/0154890 A1 Jun. 20, 2013

(30) Foreign Application Priority Data

Dec. 15, 2011 (TW) ..... 100146526 A

(51) Int. Cl.
*H01Q 1/32* (2006.01)

(52) U.S. Cl.
USPC ..... 343/713; 343/893

(58) Field of Classification Search
USPC ..... 343/711, 712, 713, 767, 893
See application file for complete search history.

(56) References Cited

U.S. PATENT DOCUMENTS

| | | | | |
|---|---|---|---|---|
| 4,864,320 | A * | 9/1989 | Munson et al. | 343/833 |
| 6,362,784 | B1 * | 3/2002 | Kane et al. | 343/700 MS |
| 7,327,320 | B2 * | 2/2008 | Dejean | 343/702 |
| 2006/0097935 | A1 * | 5/2006 | Colburn et al. | 343/713 |
| 2013/0076580 | A1 * | 3/2013 | Zhang et al. | 343/720 |

* cited by examiner

*Primary Examiner* — Hoanganh Le
(74) *Attorney, Agent, or Firm* — McDermott Will & Emery LLP

(57) ABSTRACT

An antenna device is provided and includes a bottom, two monopole antennas, and a cover assembled with the bottom. A projection plane is defined perpendicular to the bottom. The two monopole antennas substantially symmetrically protrude from the bottom, and a gap is formed between the two monopole antennas. Projections of the two monopole antennas on the projection plane intersect with each other. Each of the two monopole antennas includes a first frequency receiving portion adjacent to the bottom, a second frequency receiving portion, and a connection portion located between the first frequency receiving portion and the second frequency receiving portion. A slot is formed through the connection portion to adjust a received frequency of the first or second frequency receiving portion. An accommodating space is formed between the cover and the bottom to accommodate the two monopole antennas.

13 Claims, 14 Drawing Sheets

Legend (MHz)
— 700.00
— 704.00
- - 734.00
- - 746.00
—·— 751.00
— 756.00
— 777.00
— 782.00
— 787.00
- - 824.00
- - 836.00
—·— 849.00
— 869.00
— 880.00
— 894.00
— 900.00
- - 915.00
- - 925.00
—·— 940.00
— 960.00
— 1575.00
— 1710.00
— 1750.00
- - 1785.00
- - 1805.00
—·— 1840.00
— 1850.00
— 1880.00
— 1910.00
— 1920.00
- - 1930.00
- - 1950.00
—·— 1960.00

Legend (MHz)
- 700.00
- 704.00
- 734.00
- 746.00
- 751.00
- 756.00
- 777.00
- 782.00
- 787.00
- 824.00
- 836.00
- 849.00
- 869.00
- 880.00
- 894.00
- 900.00
- 915.00
- 925.00
- 940.00
- 960.00
- 1575.00
- 1710.00
- 1750.00
- 1785.00
- 1805.00
- 1840.00
- 1850.00
- 1880.00
- 1910.00
- 1920.00
- 1930.00
- 1950.00
- 1960.00

ANTENNA DEVICE

RELATED APPLICATIONS

This application claims priority to Taiwan Application Serial Number 100146526, filed Dec. 15, 2011, which is herein incorporated by reference.

BACKGROUND

1. Technical Field

The present disclosure relates to an antenna device, and more particularly to an antenna device including two monopole antennas.

2. Description of Related Art

In recent years, different types of wireless communication signals applied in technically advanced consumer electronic products have been prosperously developed, such as the signals of AM/FM, global system for mobile communications (GSM), global positioning system (GPS), satellite digital audio radio service (SDARS), digital video broadcasting (DVB), etc. In addition, the wireless communication devices applied to automotive electronics are also benefited by the evolutions of consumer electronic products and wireless communication signals. Therefore, it has become a development trend of the automotive electronics for manufacturers to integrate antenna devices of various wireless communication systems recently.

Since having a simple design and features of small volume and high gain relative to a dipole antenna a typical monopole antenna can be easily applied to vehicle-use communication systems. However, with regard to the monopole antenna for receiving a low-band frequency (e.g., 700 MHz), the length of the monopole antenna is too long in consideration of the mechanism limit resulted from wind pressure generated by a moving car. On the other hand, a vehicle-use antenna can be disposed on a car roof, and protected by a fin-shaped shell from being damaged by sun, rain, or wind. However, within a limited space, a plurality of antennas are often needed to be placed for receiving different types of wireless communication signals. Since long term evolution (LTE) techniques use many frequency bands and most of them are broadband designs, such that they are very challenging to the two monopole antennas with multiple input multiple output (MIMO). For example, because being significantly high, the low frequency receiving portion of the LTE antenna is limited by the space of the fin-shaped shell.

Moreover, the two monopole antennas with the typical MIMO need to have a sufficient distance therebetween to improve isolation. Therefore, when being disposed in the fin-shaped shell, the two monopole antennas may easily lose the original features of MIMO antenna due to significantly high mutual coupling effect.

SUMMARY

An aspect of the present invention is to provide an antenna device.

In an embodiment of the present invention, an antenna device includes a bottom, two monopole antennas, and a cover assembled with the bottom. A projection plane is defined perpendicular to the bottom. The two monopole antennas substantially symmetrically protrude from the bottom, and a gap is formed between the two monopole antennas. Projections of the two monopole antennas on the projection plane intersect with each other. Each of the two monopole antennas includes a first frequency receiving portion adjacent to the bottom; a second frequency receiving portion; and a connection portion located between the first frequency receiving portion and the second frequency receiving portion. A slot is formed through the connection portion to adjust a received frequency of the first frequency receiving portion or the second frequency receiving portion. An accommodating space is formed between the cover and the bottom to accommodate the two monopole antennas.

In an embodiment of the present invention, the connection portion is obliquely connected to the first frequency receiving portion, and a first intersection point is formed by projections of the two connection portions of the two monopole antennas on the projection plane.

In an embodiment of the present invention, the connection portion is obliquely connected to the second frequency receiving portion, and a second intersection point is formed by projections of the two second frequency receiving portions of the two monopole antennas on the projection plane.

In an embodiment of the present invention, the first frequency receiving portion inclinedly protrudes from the bottom, and a first intersection point is formed by projections of the two first frequency receiving portions of the two monopole antennas on the projection plane.

In an embodiment of the present invention, a second intersection point may be formed by projections of the two first frequency receiving portion, the two second frequency receiving portion, or the two connection portion of the two monopole antennas on the projection plane. The positions or the number of the intersection points may be adjusted in accordance with requirements.

In an embodiment of the present invention, an included angle in a range from 60 degrees to 120 degrees is formed by projections of the two monopole antennas on the projection plane.

In an embodiment of the present invention, the gap is in a range from 3 cm to 10 cm.

In an embodiment of the present invention, the antenna device further includes a printed circuit board located on the bottom, and the two monopole antennas substantially symmetrically protrude from the printed circuit board.

In an embodiment of the present invention, the antenna device further includes two supporting boards disposed upright on the bottom or the printed circuit board, and each of the two supporting boards is used to support each of the two monopole antennas.

In an embodiment of the present invention, the antenna device further includes two isolating bodies disposed upright on the printed circuit board, and the two isolating bodies are located between the two monopole antennas or the two monopole antennas are located between the two isolating bodies. Each of the two isolating bodies may have cylinder shape, board shape, or other geometric shapes.

In an embodiment of the present invention, the first frequency receiving portion further includes a feed point coupled with the printed circuit board.

In an embodiment of the present invention, each of the two monopole antennas includes a one-piece metal sheet.

In the aforementioned embodiments of the present invention, the antenna device is a multiple input multiple output (MIMO) antenna. The two monopole antennas substantially symmetrically protrude from the bottom, and projections of the two monopole antennas on the projection plane intersect with each other. Therefore, the height of each of the two monopole antennas is reduced, such that the two monopole antennas can be conveniently accommodated in the accommodating space formed between the cover and the bottom. Moreover, the isolation between the two monopole antennas is improved and the correlation between the two monopole antennas is reduced by the effect of cross polarization. As a result, the antenna device restrains the mutual coupling effect formed between the two monopole antennas, such that the communication quality of the antenna device is not be affected. In addition, the slot formed through the connection portion may be designed in accordance with received frequencies of the first frequency receiving portion or the second frequency receiving portion, such that the antenna device is a dual band antenna.

Furthermore, the antenna device may further include the two supporting boards and two isolating members. The two supporting boards support the two monopole antennas to increase the strength of the monopole antennas, such that the two monopole antennas can stand more firmly on the bottom or the printed circuit board. In addition, the two isolating bodies are located between the two monopole antennas or the two monopole antennas are located between the two isolating members (i.e., the two isolating members are located inside or outside the two monopole antennas), such that the isolation between the two monopole antennas may be further improved.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
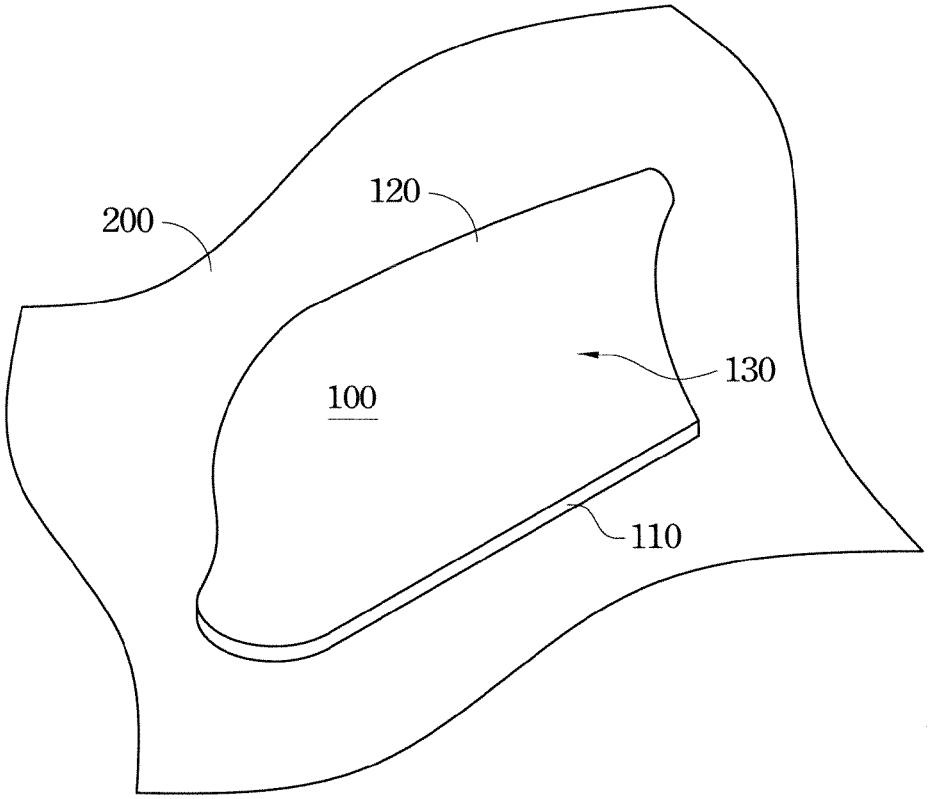
FIG. 1 is a 3-D view of an antenna device according to an embodiment of the present invention.
Figure 2:
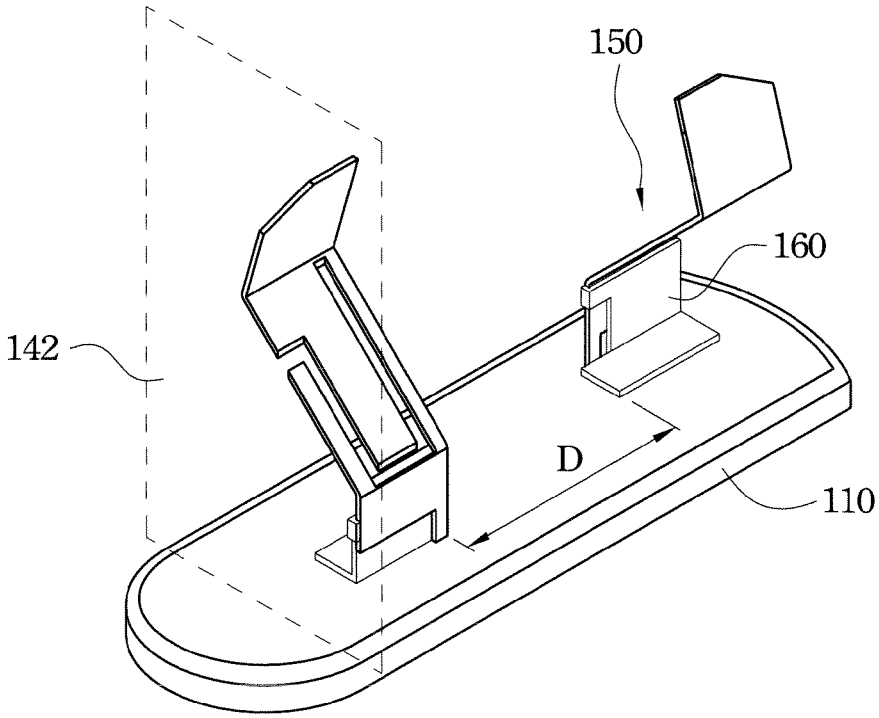
FIG. 2 is a 3-D view of the antenna device shown in FIG. 1 after a cover is removed.

FIG. 1 is a 3-D view of an antenna device 100 according to an embodiment of the present invention. FIG. 2 is a 3-D view of the antenna device 100 shown in FIG. 1 after a cover 120 is removed. As shown in FIG. 1 and FIG. 2, the antenna device 100 is a multiple input multiple output (MIMO) antenna, and the antenna device 100 may be located on a car roof 200. The antenna device 100 includes a bottom 110, two monopole antennas 150, and the cover 120. A projection plane 142 is defined perpendicular to the bottom 110. The two monopole antennas 150 substantially symmetrically protrude from the bottom 110, and a gap D is formed between the two monopole antennas 150. Projections of the two monopole antennas 150 on the projection plane 142 intersect with each other. The cover 120 is assembled with the bottom 110, and an accommodating space 130 is formed between the cover 120 and the bottom 110 to accommodate the two monopole antennas 150.

In this embodiment, the gap D may be in a range from 3 cm to 10 cm in accordance with design requirements. The material forming the cover 120 may include bismaleimide-triazine (BT) or fiberglass reinforced epoxy resin (FR4), and the material forming the bottom 110 may include metal. In addition, the shape of the cover 120 may be fin-shaped.

Furthermore, the antenna device 100 may further include two supporting boards 160 disposed upright on the bottom 110, and each of the two supporting boards 160 is used to support each of the two monopole antennas 150. The two supporting boards 160 may increase the strength of the two monopole antennas 150, such that the two monopole antennas 150 can stand more firmly on the bottom 110.

Figure 3:
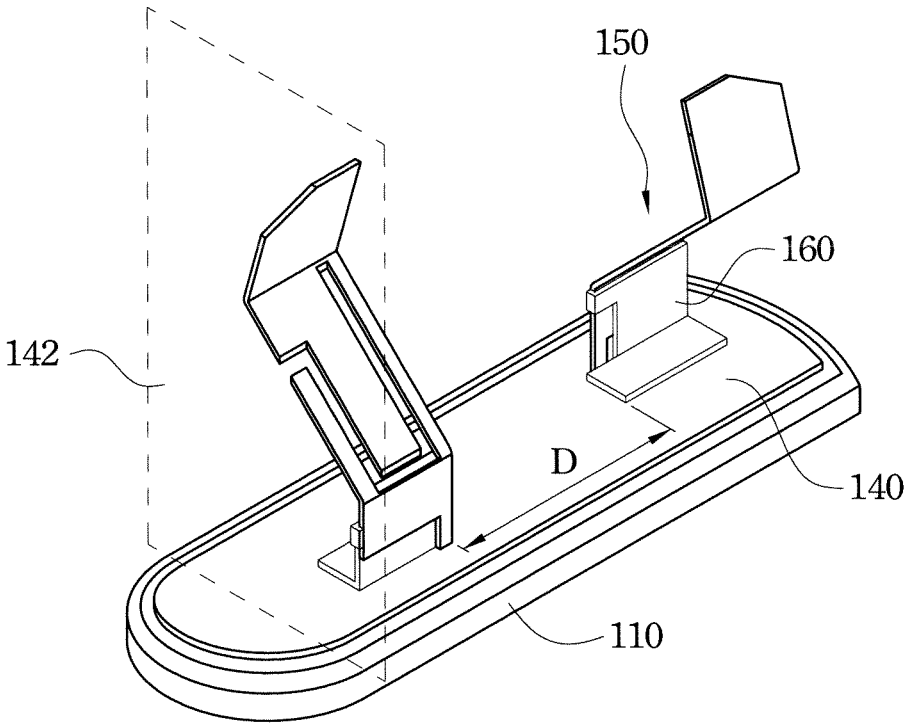
FIG. 3 is a 3-D view of an antenna device with a cover removed according to an embodiment of the present invention.

FIG. 3 is a 3-D view of an antenna device 100 (see FIG. 1) with the cover 120 removed according to an embodiment of the present invention. The difference between this embodiment and the aforementioned embodiment shown in FIG. 2 is that the antenna device 100 may optionally include a printed circuit board 140 located on the bottom 110. In this embodiment, the two monopole antennas 150 substantially symmetrically protrude from the printed circuit board 140, and the supporting board 160 is disposed upright on the printed circuit board 140. The projections of the two monopole antennas 150 on the projection plane 142 remain intersect with each other, and each of the two monopole antennas 150 may still be supported by each of the two supporting boards 160, such that the two monopole antennas 150 can stand more firmly on the printed circuit board 140.

Because the printed circuit board 140 is located on the bottom 110, the material forming the bottom 110 may be nonmetal. In this embodiment, the materials forming the cover 120 and the bottom 110 may include bismaleimide-triazine (BT) or fiberglass reinforced epoxy resin (FR4).

In the below, the structure of the monopole antenna 150 and the intersection manner of the two monopole antennas 150 of the embodiment shown in FIG. 2 will be described in detail, but it is to be noted that the monopole antenna 150 described below may also be applied to the embodiment including the printed circuit board 140 shown in FIG. 3.

Figure 4:
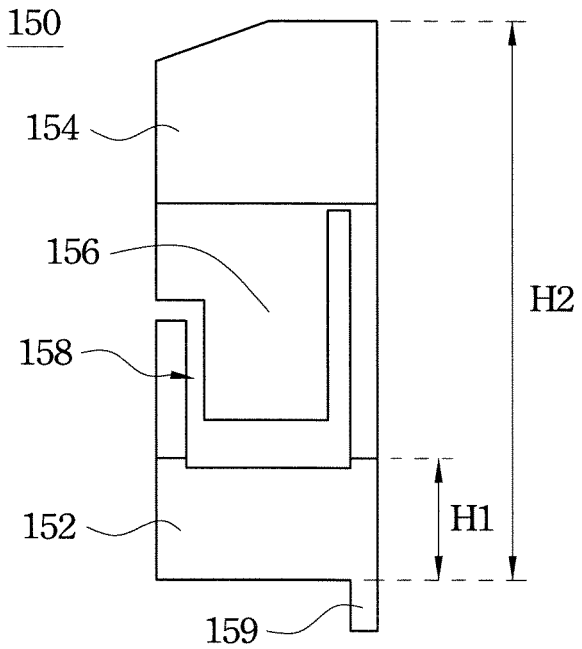
FIG. 4 is a front view of a monopole antenna shown in FIG. 2.
Figure 5:
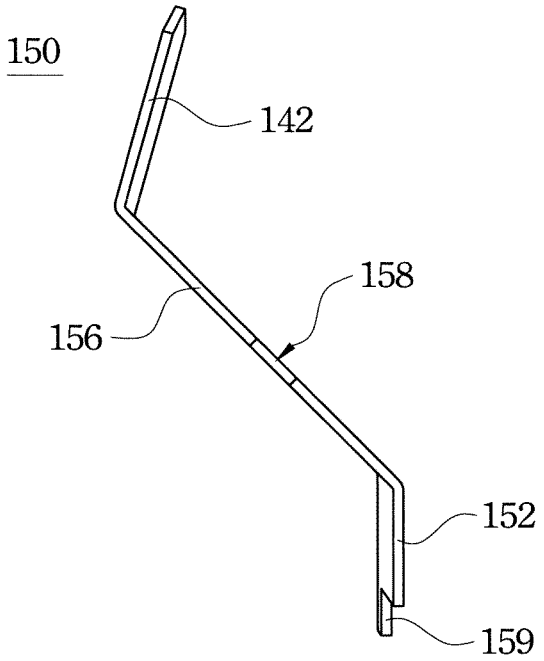
FIG. 5 is a side view of the monopole antenna shown in FIG. 4.

FIG. 4 is a front view of the monopole antenna 150 shown in FIG. 2. FIG. 5 is a side view of the monopole antenna 150 shown in FIG. 4. As shown in FIG. 4 and FIG. 5, the monopole antenna 150 includes a first frequency receiving portion 152 adjacent to the bottom 110 (see FIG. 2), a second frequency receiving portion 154, and a connection portion 156 between the first frequency receiving portion 152 and the second frequency receiving portion 154. Moreover, a slot 158 is formed through the connection portion 156 to adjust a received frequency of the first frequency receiving portion 152 or the second frequency receiving portion 154, such that the monopole antenna 150 is a dual band antenna.

As shown in FIG. 2 and FIG. 4, a distance H1 between the first frequency receiving portion 152 and the bottom 110 is smaller than a distance H2 between the second frequency receiving portion 154 and the bottom 110. In this embodiment, the first frequency receiving portion 152 may receive low frequency signals (e.g., from 746 MHz to 849 MHz), and the second frequency receiving portion 154 may receive high frequency signals (e.g., from 1710 MHz to 2155 MHz). The first frequency receiving portion 152 may further include a feed point 159 coupled to the printed circuit board 140 (see FIG. 3). The monopole antenna 150 may be a one-piece metal sheet, such that the cost of the material forming the monopole antenna 150 can be reduced. Furthermore, a conductive coating may be formed on the metal sheet by coating, printing, laser engraving, etching, or vapor deposition. In addition, paint and adhesive may also be applied to the metal sheet for isolation.

Figure 6:
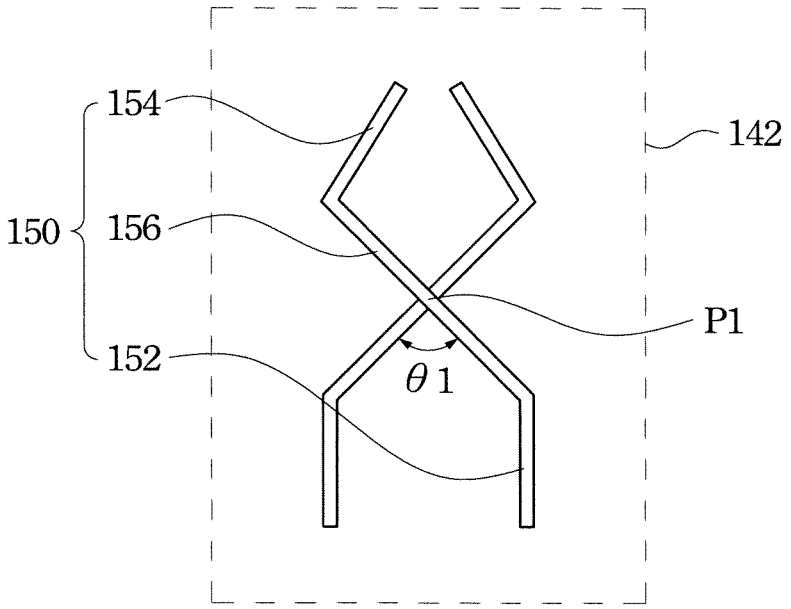
FIG. 6 illustrates projections of the two monopole antennas of FIG. 2 on a projection plane.

FIG. 6 is illustrates projections of the two monopole antennas 150 of FIG. 2 on the projection plane 142. As shown in FIG. 2 and FIG. 6, the projections of the two monopole antennas 150 on the projection plane 142 intersect with each other. In this embodiment, the connection portion 156 is obliquely connected to the first frequency receiving portion 152 and the second frequency receiving portion 154. A first intersection point P1 is formed by the projections of the two connection portions 156 of the two monopole antennas 150 on the projection plane 142. As a result, an included angle θ1 is formed by the projections of the two monopole antennas 150 on the projection plane 142, and the included angle θ1 may be in a range from 60 degrees to 120 degrees.

Referring to FIG. 4 simultaneously, the two monopole antennas 150 are disposed upright on the bottom 110 in a symmetrical arrangement, and the projections of the two monopole antennas 150 on the projection plane 142 intersect with each other. Therefore, the height of each of the two monopole antennas 150 (i.e., the distance H2 between the second frequency receiving portion 154 and the bottom 110) can be reduced, such that the two monopole antennas 150 can be conveniently accommodated in the accommodating space 130 (see FIG. 1) formed between the cover 120 (see FIG. 1) and the bottom 110. Moreover, the isolation between the two monopole antennas 150 is improved and the correlation between the two monopole antennas 150 is reduced by the effect of cross polarization. That is to say, the mutual coupling effect formed between the two monopole antennas 150 is restrained, such that the communication quality is not be affected by the mutual coupling effect and the communication transmission efficiency is improved. In addition, the slot 158 formed through the connection portion 156 may be designed in accordance with receiving frequencies of the first frequency receiving portion 152 or the second frequency receiving portion 154, such that the antenna device 100 (see FIG. 1) is a dual band antenna.

Figure 7A:
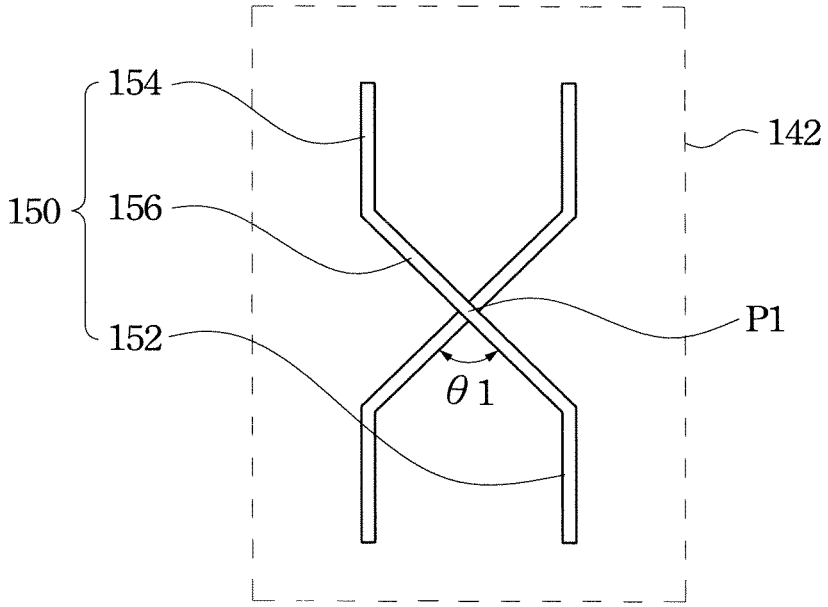
FIG. 7A illustrates projections of two monopole antennas on a projection plane according to another embodiment of the present invention.
Figure 7B:
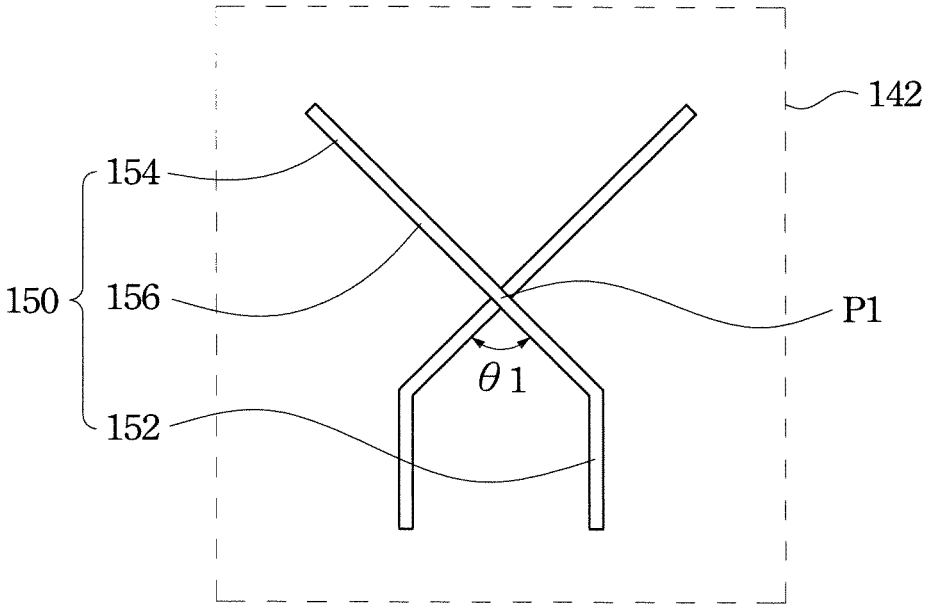
FIG. 7B illustrates projections of two monopole antennas on a projection plane according to another embodiment of the present invention.
Figure 7C:
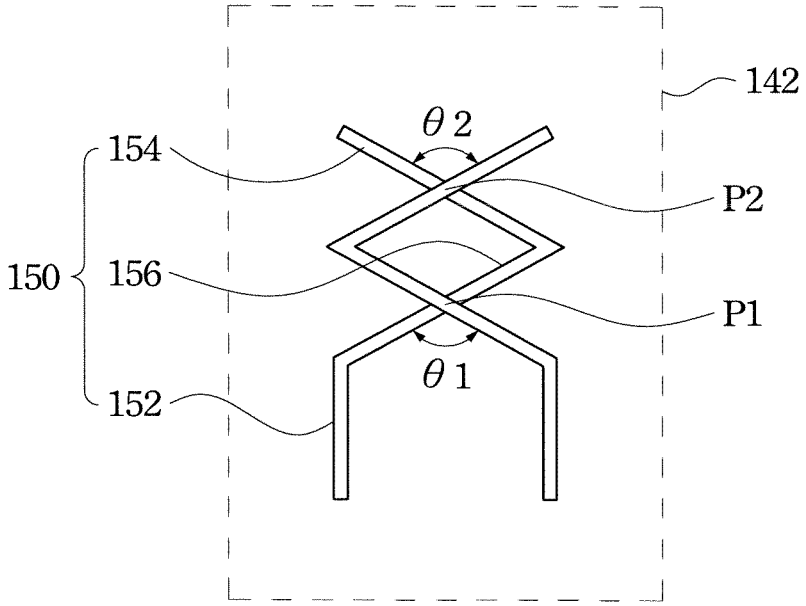
FIG. 7C illustrates projections of two monopole antennas on a projection plane according to another embodiment of the present invention.
Figure 7D:
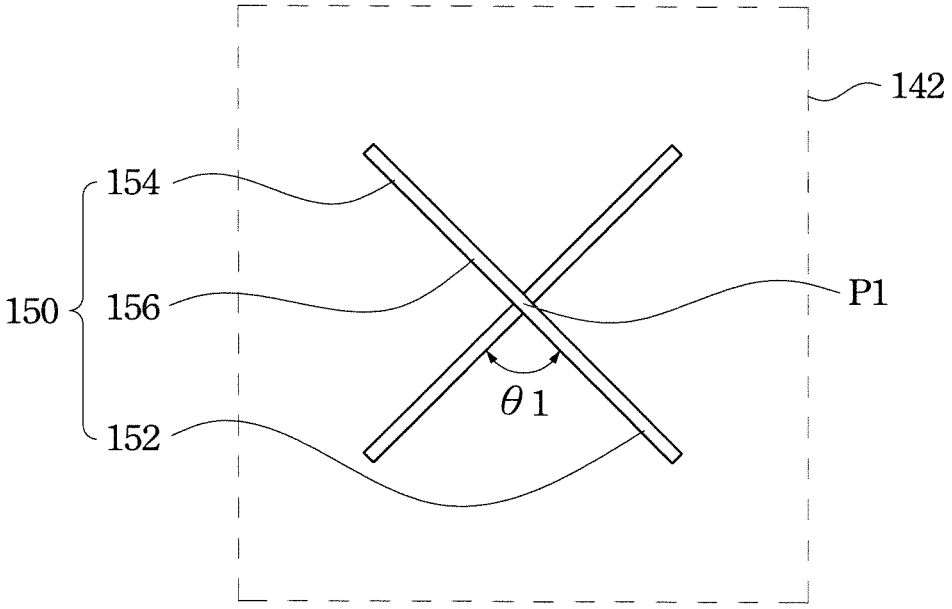
FIG. 7D illustrates projections of two monopole antennas on a projection plane according to another embodiment of the present invention.

FIG. 7A to FIG. 7D illustrates projections of the two monopole antennas 150 on the projection plane 142 according to other embodiments of the present invention. Compared with the embodiment shown in FIG. 6, the oblique angle between the second frequency receiving portion 154 and the connection portion 156 of each of the two monopole antennas 150 shown in FIG. 7A is smaller. In FIG. 7B, there is no oblique angle between the second frequency receiving portion 154 and the connection portion 156 of each of the two monopole antennas 150. In FIG. 7C, the oblique angle between the second frequency receiving portion 154 and the connection portion 156 of each of the two monopole antennas 150 is larger, such that the first intersection point P1 is formed by the projections of the two connection portions 156 on the projection plane 142, and a second intersection point P2 is formed by the projections of the two second frequency receiving portions 154 on the projection plane 142. Therefore, two included angles θ1, θ2 are formed by the projections of the two monopole antennas 150 on the projection plane 142, and the included angles θ1, θ2 may be in a range from 60 to 120 degrees, respectively. In FIG. 7D, there is no oblique angle between the first frequency receiving portion 152 and the connection portion 156, and between the second frequency receiving portion 154 and the connection portion 156 of each of the two monopole antennas 150. The first frequency receiving portion 152 inclinedly protrudes from the bottom 110 (see FIG. 2), and the first intersection point P1 is formed by the projections of the two first frequency receiving portions 152 or the two connection portion 156 of the two monopole antennas 150 on the projection plane 142.

In the aforementioned embodiments, the two first frequency receiving portions 152 of the two monopole antennas 150 may intersect with each other, and the two first frequency receiving portions 152 of the two monopole antennas 150 may intersect with each other, and the two connection portion 156 of the two monopole antennas 150 may intersect with each other. That is, the positions or the number of the intersection points of the two monopole antennas 150 located on the projection plane 142 may be adjust in accordance with requirements, and do not limit the present invention.

The contents which have been described above will not be repeated in the following description, and only aspects related to other components located in the antenna device 100 (see FIG. 1) will be described.

Figure 8:
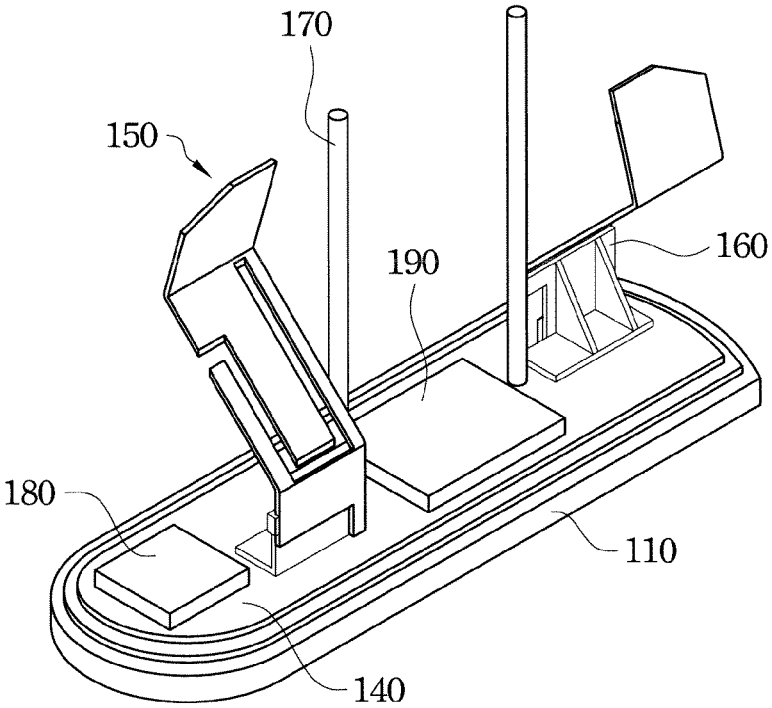
FIG. 8 is a 3-D view of an antenna device with a cover removed according to an embodiment of the present invention.

FIG. 8 is a 3-D view of an antenna device 100 (see FIG. 100) with the cover 120 removed according to an embodiment of the present invention. As show in FIG. 1 and FIG. 8, the antenna device 100 may further include two isolating bodies 170 disposed upright on the printed circuit board 140. In this embodiment, the two isolating members 170 are located between the two monopole antennas 150 (i.e., the two isolating members 170 are located inside the two monopole antennas 150). As a result, the isolation between the two monopole antennas 150 may be further improved by the two isolating members 170. The material forming the isolating members 170 may be metal, and each of the two isolating members 170 may have cylinder shape, board shape, or other geometric shapes. Furthermore, other types of antennas 180, 190 may also be mounted on the printed circuit board 140. For example, the antenna 180 may be an antenna for global navigation satellite system (GLONASS), and the antenna 190 may be an antenna for global positioning system (GPS).

Figure 9:
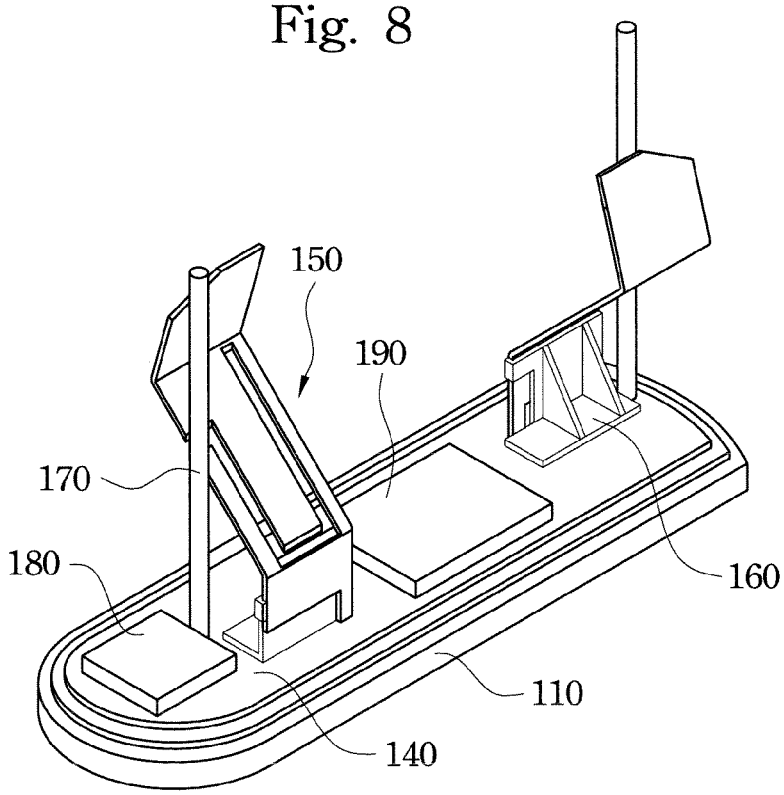
FIG. 9 is a 3-D view of an antenna device with a cover removed according to another embodiment of the present invention.

FIG. 9 is a 3-D view of an antenna device 100 (see FIG. 1) removing a cover 120 according to an embodiment of the present invention. The difference between this embodiment and the aforementioned embodiment shown in FIG. 8 is that the two monopole antennas 150 are located between the two isolating members 170 (i.e., the two isolating members 170 are located outside the two monopole antennas 150), such that the isolation between the two monopole antennas 150 may also be further improved by the two isolating members 170.

Figure 10A:
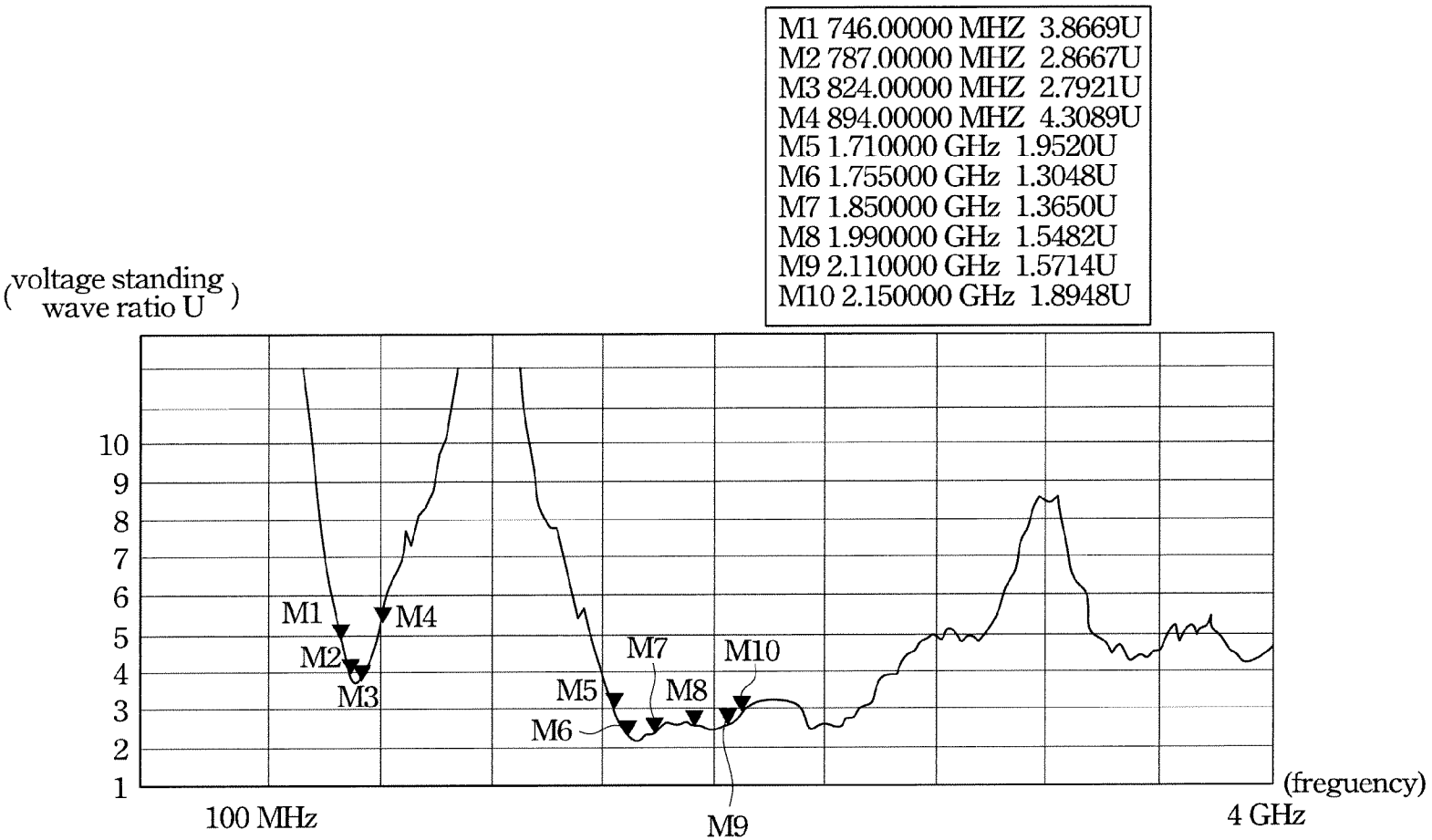
FIG. 10A to FIG. 10B are diagrams showing the relationships between voltage standing wave ratios and working frequencies for the two monopole antennas shown in FIG. 2.
Figure 10B:
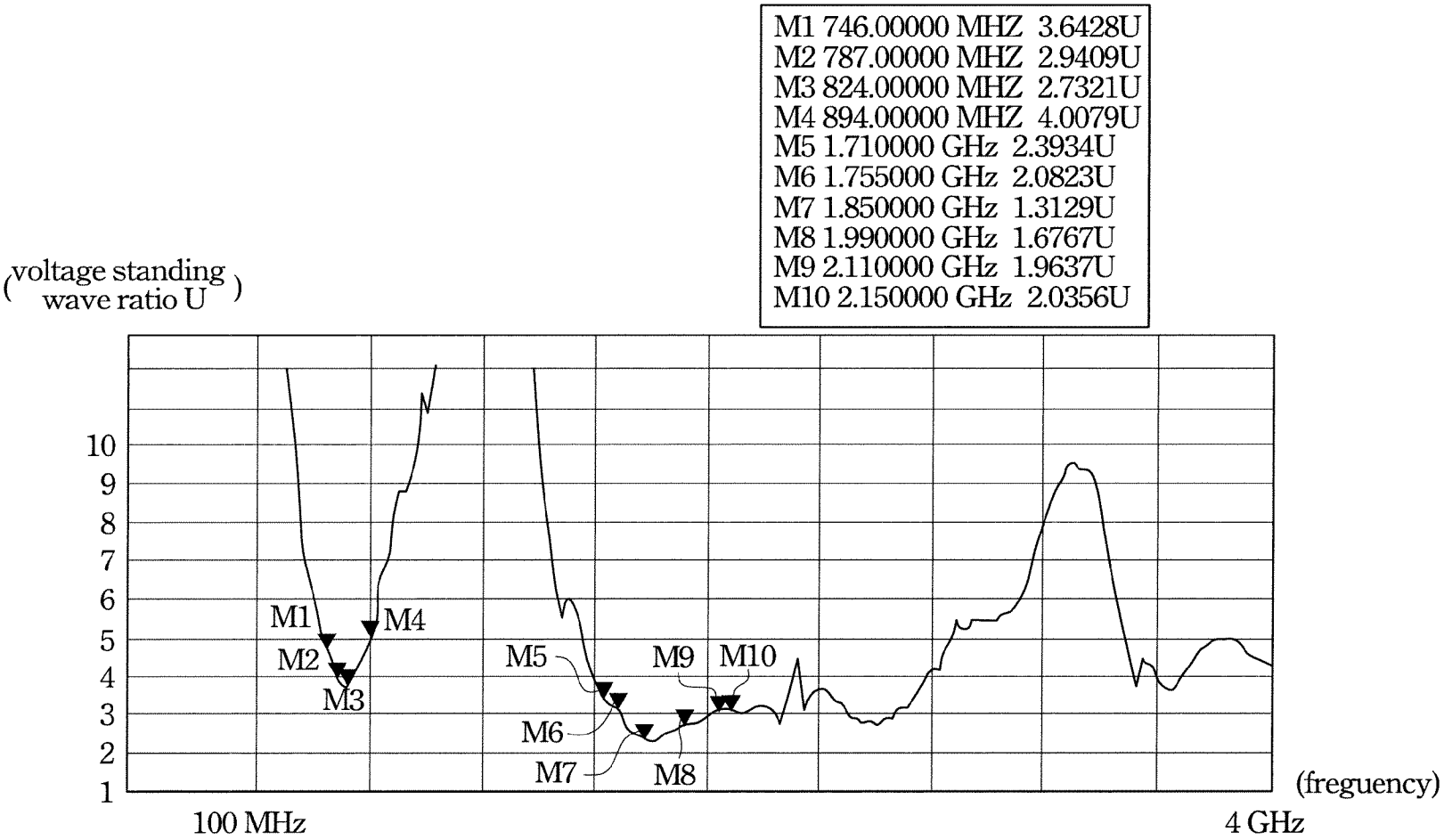
Figure 11A:
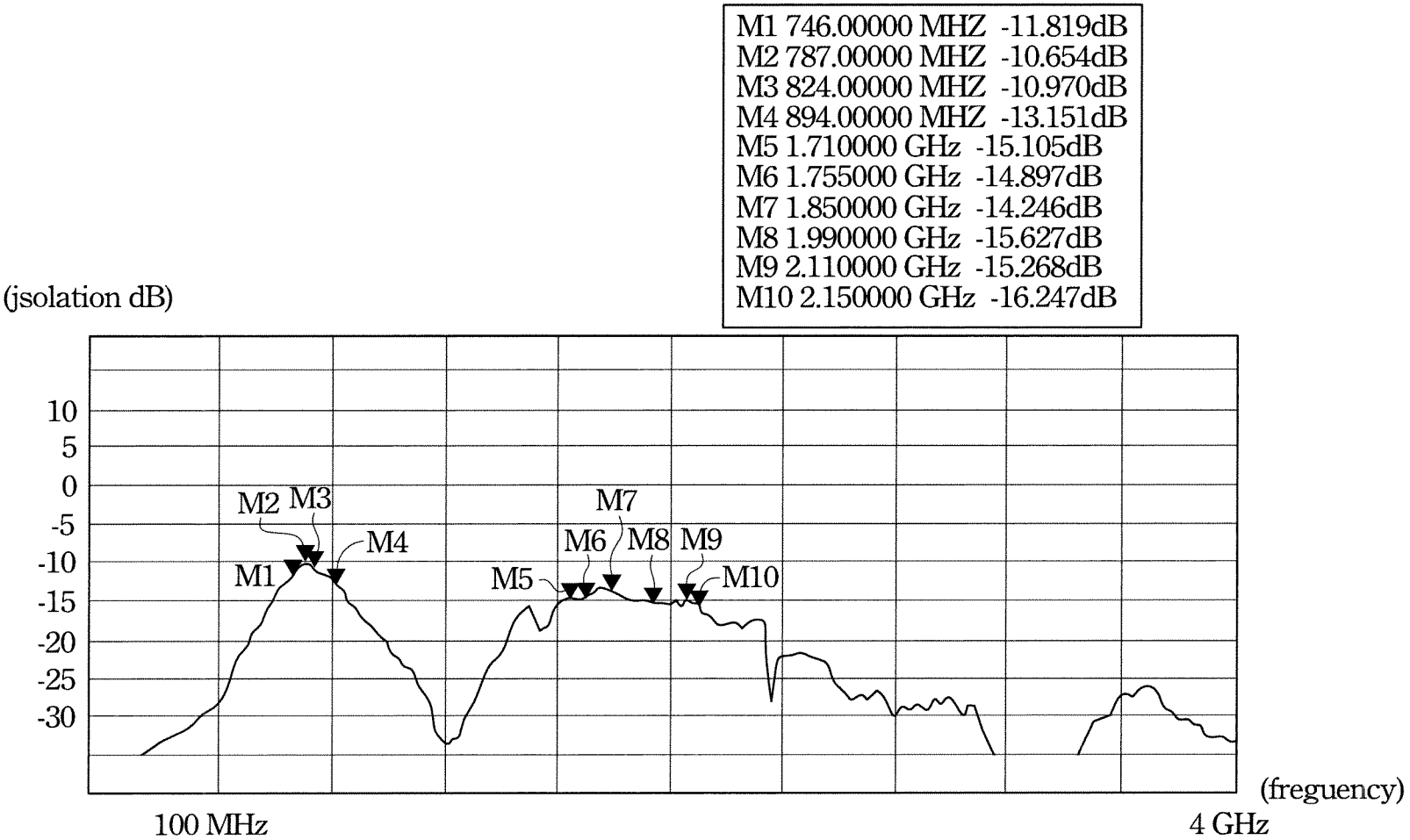
FIG. 11A to FIG. 11B are diagrams showing the relationships between degrees of isolation and working frequencies for the two monopole antennas shown in FIG. 2.
Figure 11B:
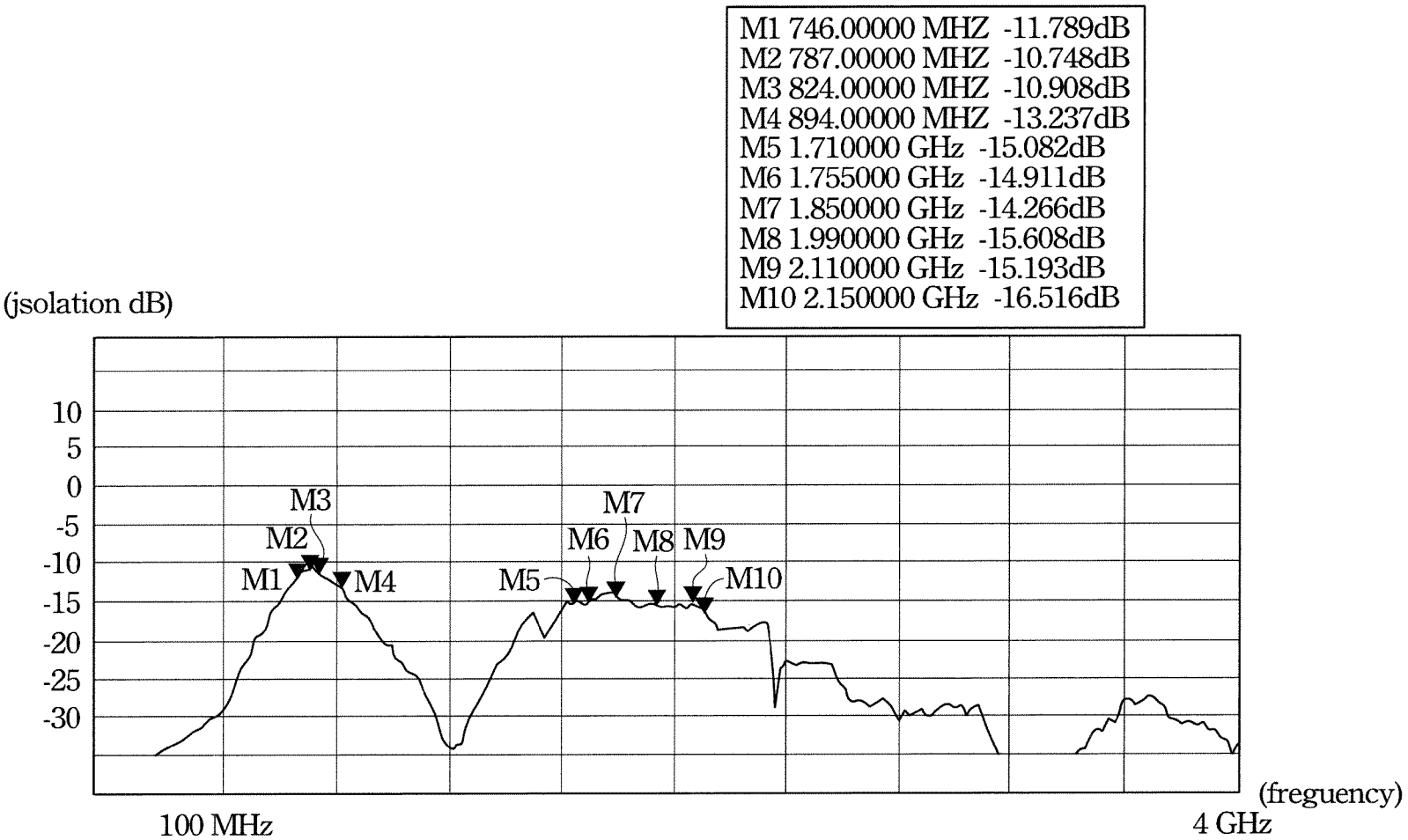

FIG. 10A to FIG. 10B are diagrams showing the relationships between voltage standing wave ratio and working frequency graphs of the two monopole antennas 150 shown in FIG. 2. FIG. 11A to FIG. 11B are diagrams showing the relationships between degrees of isolation and working frequencies for the two monopole antennas 150 shown in FIG. 2. Measurement points M1 to M10 shown in FIG. 10A to FIG. 11B are corresponding to different working frequencies.

Figure 12A:
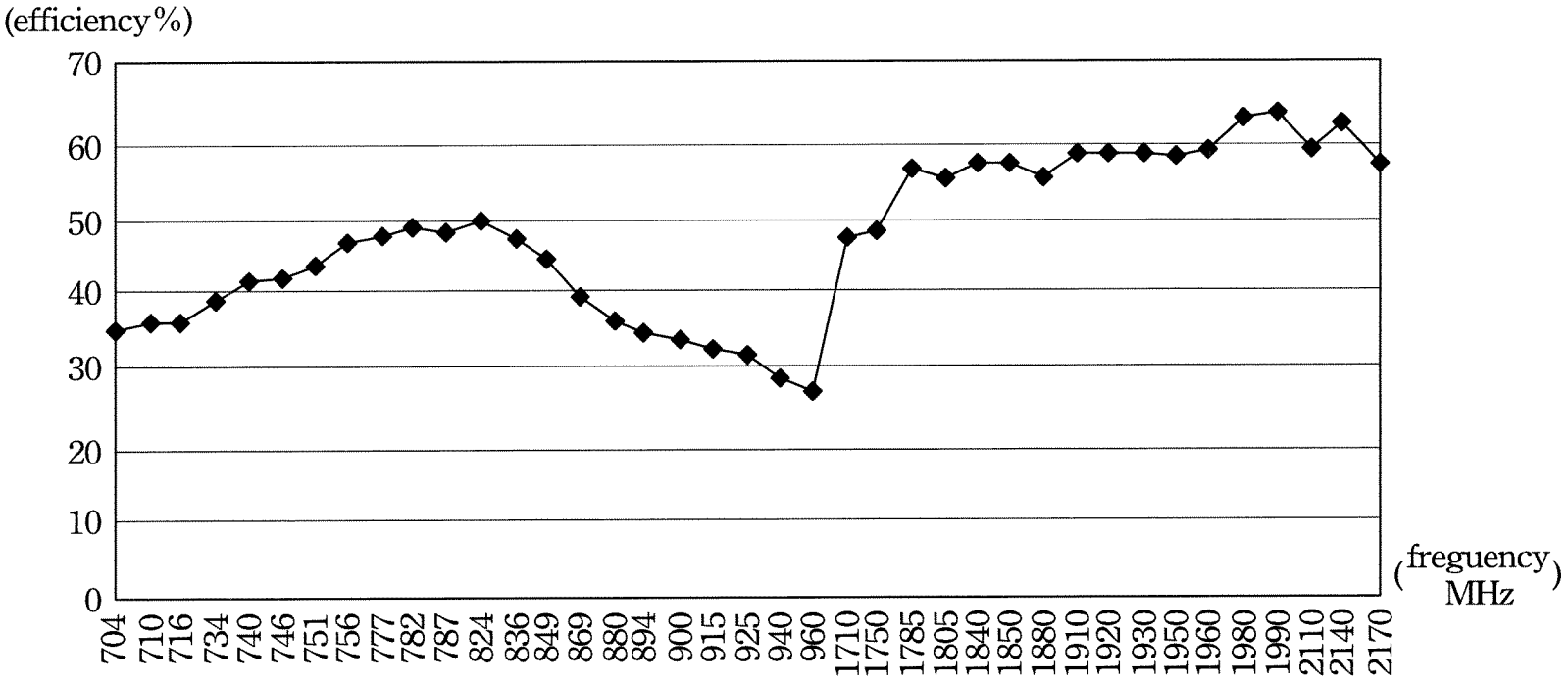
FIG. 12A to FIG. 12B are diagrams showing the relationships between radiation efficiencies and working frequencies graphs for the two monopole antennas shown in FIG. 2.
Figure 12B:
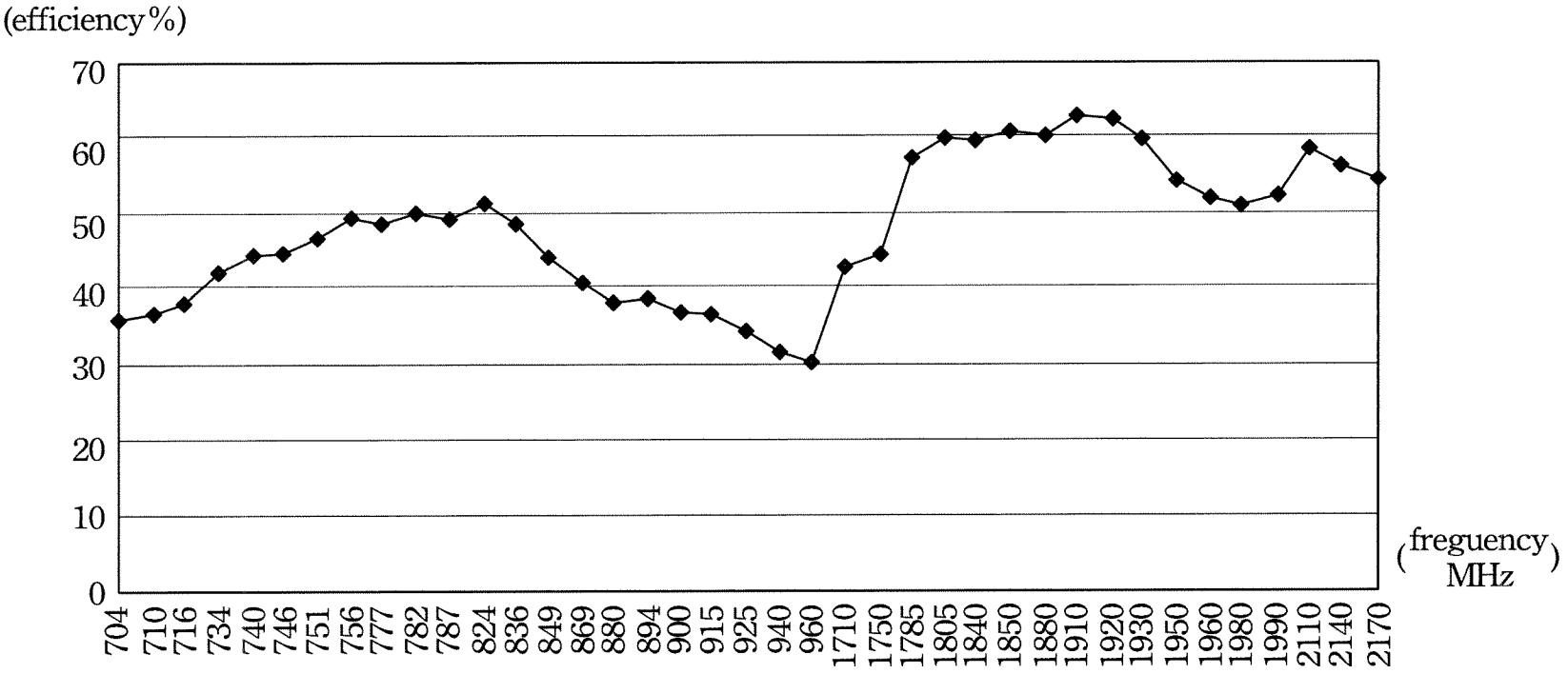
Figure 13A:
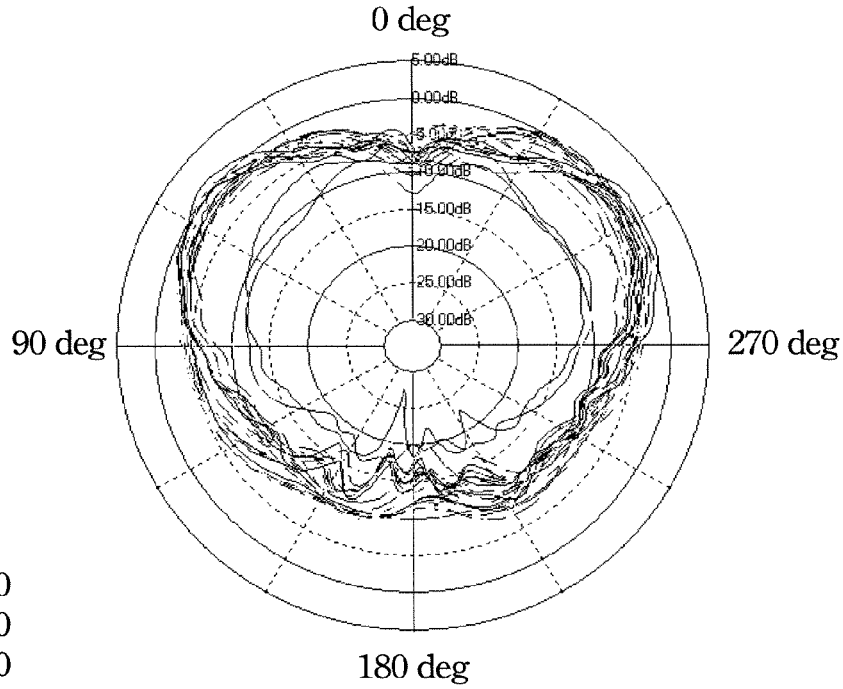
FIG. 13A to FIG. 13B are diagrams showing 2-dimensional E-plane graphs corresponding to working frequencies of the two monopole antennas shown in FIG. 2.
Figure 13B:
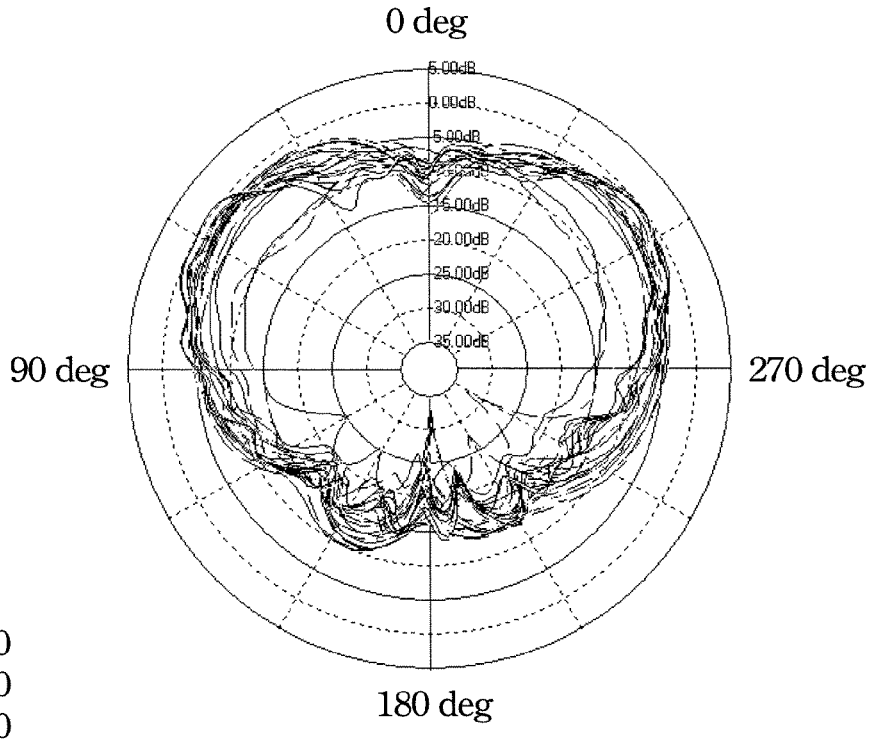

FIG. 12A to FIG. 12B are diagrams showing the relationships between radiation efficiencies and working frequencies for the two monopole antennas 150 shown in FIG. 2. FIG. 13A to FIG. 13B are diagrams showing 2-dimensional E-plane graphs corresponding to working frequencies of the two monopole antennas 150 shown in FIG. 2. According to the graphs shown in FIG. 10A to FIG. 13B, the antenna device 100 (see FIG. 1) including the two monopole antennas 150 can stably and normally work.

Compared with a conventional antenna device, the two aforementioned monopole antennas substantially symmetrically protrude from the bottom or the printed circuit board, and the projections of the two monopole antennas on the projection plane intersect with each other. Therefore, the height of each of the two monopole antennas is be reduced, such that the two monopole antennas can be conveniently accommodated in the accommodating space formed between the cover and the bottom. Moreover, the two monopole antennas are disposed upright on the bottom or the printed circuit board in a symmetrical arrangement, and the projections of the two monopole antennas on the projection plane intersect with each other, such that the isolation between the two monopole antennas is improved and the correlation between the two monopole antennas is reduced by the effect of cross polarization. As a result, the communication transmission efficiency of the antenna device is improved. In addition, the slot formed through the connection portion can be designed in accordance with received frequencies of the first frequency receiving portion or the second frequency receiving portion, such that the antenna device is a dual band antenna.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. An antenna device comprising:

a bottom, wherein a projection plane is defined perpendicular to the bottom;

two monopole antennas substantially symmetrically protruding from the bottom, wherein a gap is formed between the two monopole antennas, and projections of the two monopole antennas on the projection plane intersect with each other, and each of the two monopole antennas comprises:

a first frequency receiving portion adjacent to the bottom;

a second frequency receiving portion; and a connection portion located between the first frequency receiving portion and the second frequency receiving portion, wherein a slot is formed through the connection portion for adjusting a receiving frequency of the first frequency receiving portion or the second frequency receiving portion; and a cover assembled with the bottom, wherein an accommodating space is formed between the cover and the bottom for accommodating the two monopole antennas.

2. The antenna device as claimed in claim 1, wherein the connection portion is obliquely connected to the first frequency receiving portion, and a first intersection point is formed by projections of the two connection portions of the two monopole antennas on the projection plane.

3. The antenna device as claimed in claim 2, wherein the connection portion is obliquely connected to the second frequency receiving portion, and a second intersection point is formed by projections of the two second frequency receiving portions of the two monopole antennas on the projection plane.

4. The antenna device as claimed in claim 1, wherein the first frequency receiving portion protrudes inclinedly from the bottom, and a first intersection point is formed by projections of the two first frequency receiving portions of the two monopole antennas on the projection plane.

5. The antenna device as claimed in claim 1, wherein an included angle in a range from 60 degrees to 120 degrees is formed by projections of the two monopole antennas on the projection plane.

6. The antenna device as claimed in claim 1, wherein the gap is in a range from 3 cm to 10 cm.

7. The antenna device as claimed in claim 1, further comprising:

two supporting boards disposed upright on the bottom for supporting the two monopole antennas respectively.

8. The antenna device as claimed in claim 1, wherein each of the two monopole antennas comprises a one-piece metal sheet.

9. The antenna device as claimed in claim 1, further comprising:

a printed circuit board located on the bottom, wherein the two monopole antennas substantially symmetrically protrude from the printed circuit board.

10. The antenna device as claimed in claim 9, further comprising:

two supporting boards disposed upright on the printed circuit board for supporting the two monopole antennas respectively.

11. The antenna device as claimed in claim 9, further comprising:

two isolating members disposed upright on the printed circuit board and located between the two monopole antennas.

12. The antenna device as claimed in claim 9, further comprising:

two isolating members disposed upright on the printed circuit board, wherein the two monopole antennas are located between the two isolating members.

13. The antenna device as claimed in claim 9, wherein the first frequency receiving portion further comprises:

a feed point coupled to the printed circuit board.

* * * * *